US010431895B2

(12) United States Patent
Chung et al.

(10) Patent No.: US 10,431,895 B2
(45) Date of Patent: Oct. 1, 2019

(54) DUAL SLOT SIW ANTENNA UNIT AND ARRAY MODULE THEREOF

(71) Applicant: CUBTEK INC., Hsinchu County (TW)

(72) Inventors: Shyh-Jong Chung, Hsinchu County (TW); Hsiao-Ning Wang, Hsinchu County (TW)

(73) Assignee: CUBTEK INC., Hsinchu County (TW)

( * ) Notice: Subject to any disclaimer, the term of this patent is extended or adjusted under 35 U.S.C. 154(b) by 246 days.

(21) Appl. No.: 15/474,241

(22) Filed: Mar. 30, 2017

(65) Prior Publication Data

US 2017/0288313 A1 Oct. 5, 2017

(30) Foreign Application Priority Data

Mar. 31, 2016 (TW) ..... 105110414 A

(51) Int. Cl.

| | |
|---|---|
| ***H01Q 13/10*** | (2006.01) |
| ***H01P 3/08*** | (2006.01) |
| ***H01Q 1/50*** | (2006.01) |
| ***H01Q 21/00*** | (2006.01) |

(52) U.S. Cl.

CPC ..... *H01Q 13/106* (2013.01); *H01P 3/08* (2013.01); *H01Q 1/50* (2013.01); *H01Q 21/005* (2013.01); *H01Q 21/0043* (2013.01)

(58) Field of Classification Search

CPC .. H01Q 21/005; H01Q 21/0043; H01Q 13/10; H01Q 3/26; H01Q 21/08; H01Q 1/246

USPC ..... 343/771, 762, 772, 853, 844

See application file for complete search history.

(56) References Cited

U.S. PATENT DOCUMENTS

| | | | | |
|---|---|---|---|---|
| 2015/0222023 A1* | 8/2015 | Shijo | ..... | H01Q 13/18 342/195 |
| 2015/0229027 A1* | 8/2015 | Sonozaki | ..... | H01Q 13/10 343/771 |
| 2016/0056541 A1* | 2/2016 | Tageman | ..... | H01Q 13/18 343/771 |

* cited by examiner

*Primary Examiner* — Dameon E Levi
*Assistant Examiner* — Collin Dawkins
(74) *Attorney, Agent, or Firm* — Muncy, Geissler, Olds & Lowe, P.C.

(57) ABSTRACT

A dual slot SIW antenna unit includes a first substrate, a conductive layer, plural unit radiation members, a second substrate, a ground conductive layer, and two first conductor pillars. The plural unit radiation members are disposed in parallel on the conductive layer, and each unit radiation member includes at least a pair of slots that are disposed in parallel. The two first conductive pillars are disposed between two neighboring unit radiation members and electrically connect the feed routing layer and the conductive layer. A dual slot SIW antenna array module is also disclosed. By use of the dual slot structure, more radiation members are allowed to be included in a limited square measure for improving the antenna gain.

17 Claims, 6 Drawing Sheets

DUAL SLOT SIW ANTENNA UNIT AND ARRAY MODULE THEREOF

BACKGROUND OF THE INVENTION

1. Field of the Invention

The present invention relates to antenna modules, and more particularly, to a dual slot SIW antenna unit and array module thereof.

2. Description of the Related Art

As shown by FIG. 1, a known antenna structure 1 of prior arts includes an antenna substrate 10, a feed substrate 11, a ground layer 12, a metal layer 13, and a microstrip feed line 14. The antenna structure 1 is formed of two overlapped substrates, with the ground layer 12 disposed between the two substrates, and the metal layer 13 is disposed on an upper surface of the antenna substrate 10. The ground layer 12 is provided with an opening 121 disposed thereon. The microstrip feed line 14 is disposed on a bottom portion of the feed substrate 11, and the microstrip feed line 14 feeds a wireless signal to the metal layer 13 via the opening 121. However, besides a relatively smaller bandwidth of such antenna structure 1, the reverse-phase radiation thereof is relative large. Also, unnecessary surface wave radiation may even occurs.

An improvement to the structure above is disclosed. A metal conductive pillar is added to be disposed in adjacent to each opening for counteracting reflection, so as to form a progressive wave and reach a larger bandwidth. However, when applied to a millimeter wave frequency band, wavelength of the frequency is shorter, and the method of applying the metal conductive pillar for counteracting reflection requires an accurate processing. As a result, such improvement is not suitable for this arrangement. Also, the distance of the radiation member shall be equal to one wavelength, or the gain enhancement may not be realized.

SUMMARY OF THE INVENTION

For improving the aforementioned issues, the present invention provides a dual slot SIW (substrate integrated waveguide) antenna unit and array module thereof. By use of the dual slot structure, more radiation members are allowed to be added in a limited square measure for improving the antenna gain. By feeding the SIW antenna in a reverse phase, under the asymmetric feed arrangement, the energy and phase of the antenna arrays on two sides of the upper layer are under controlled to be identical; also, the bandwidth of the antenna beam is increased.

In an embodiment of the present invention, the dual slot SIW antenna unit comprises:

a first substrate;

a conductive layer disposed on an upper surface of the first substrate;

plural unit radiation members substantially disposed in parallel relative to each other on the conductive layer, each unit radiation member including at least a pair of slots that are disposed in parallel relative to each other;

a second substrate disposed on a lower surface of the first substrate;

a ground conductive layer disposed on an upper surface of the second substrate and between the first and second substrates;

a feed routing layer disposed on a lower surface of the second substrate; and two first conductive pillars disposed between two neighboring unit radiation members, passing through the first substrate and the second substrate, and electrically connecting the feed routing layer and the conductive layer.

In another embodiment of the present invention, a dual slot SIW antenna array module is disclosed, comprising:

a first substrate;

a conductive layer disposed on an upper surface of the first substrate;

a second substrate disposed on a lower surface of the first substrate;

a ground conductive layer disposed on an upper surface of the second substrate and between the first and second substrates;

a feed routing layer disposed on a lower surface of the second substrate; and plural dual slot SIW antenna units disposed in an array arrangement, wherein each dual slot SIW antenna unit comprises:

plural unit radiation members substantially disposed in parallel relative to each other on the conductive layer, each unit radiation member including at least a pair of slots that are disposed in parallel relative to each other;

two first conductive pillars disposed between two neighboring unit radiation members, passing through the first substrate and the second substrate, and electrically connecting the feed routing layer and the conductive layer; and plural second conductive pillars disposed around the plural unit radiation members, wherein regarding each two neighboring dual slot SIW antenna units, the plural second conductive pillars sandwiched by the two neighboring dual slot SIW antenna units are shared by the two dual slot SIW antenna units, and the feed routing layer electrically connects the plural first conductive pillars.

The objectives, technical features, and effects of the present invention are illustrated in detail with following drawings of the embodiments in accordance with the present invention.

DETAILED DESCRIPTION OF THE INVENTION

The present invention mainly provides a dual slot SIW (substrate integrated waveguide) antenna unit and array thereof. The dual slot SIW antenna unit comprises a first substrate, a conductive layer, plural radiation members, a second substrate, a ground conductive layer, and two first conductive pillars, wherein the plural unit radiation members are substantially disposed in parallel relative to each other, such that more radiation members are allowed to be added in a limited square measure, thus improving the antenna gain. Various embodiments are to be illustrated in detail with descriptive drawings as examples. Various modifications and enhancements may be made without departing from the scope of the invention. Accordingly, the invention is not to be limited except as by the appended claims. In the description of the specification, for clearly illustrating the present invention, many specific details are provided; however, the present invention is still able to be carried out with certain details being omitted. Furthermore, commonly known steps or components may not be shown in the detail description for preventing unnecessary limitations. Identical or similar components are marked with identical or similar numeric. Please note that the components are illustrated based on a proportion for explanation but not subject to the actual component proportion and amounts. Unnecessary details are omitted to achieve the briefness of the drawings.

Figure 1:
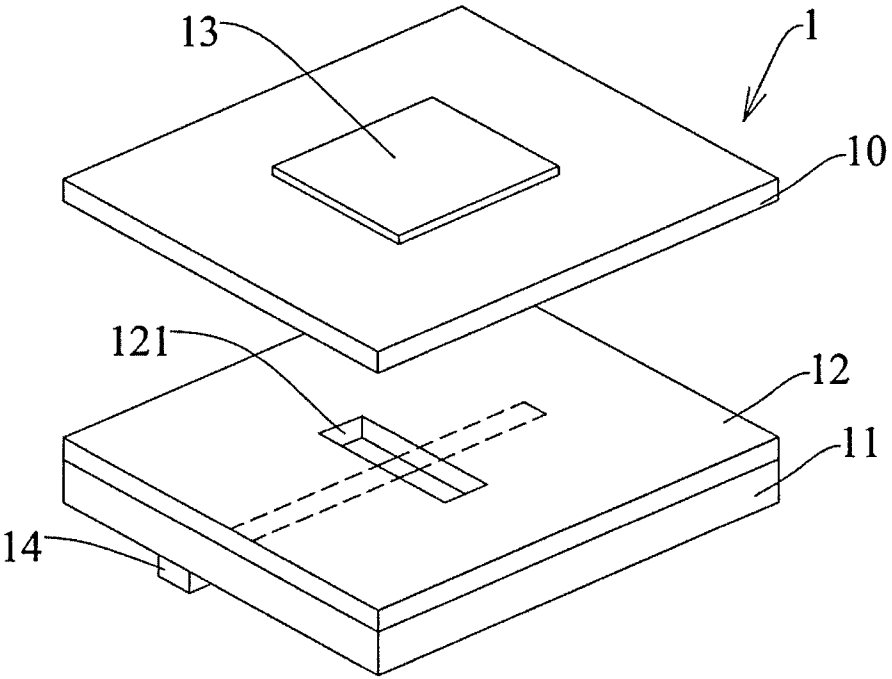
FIG. 1 is a schematic view illustrating a known antenna structure of prior arts.
Figure 2:
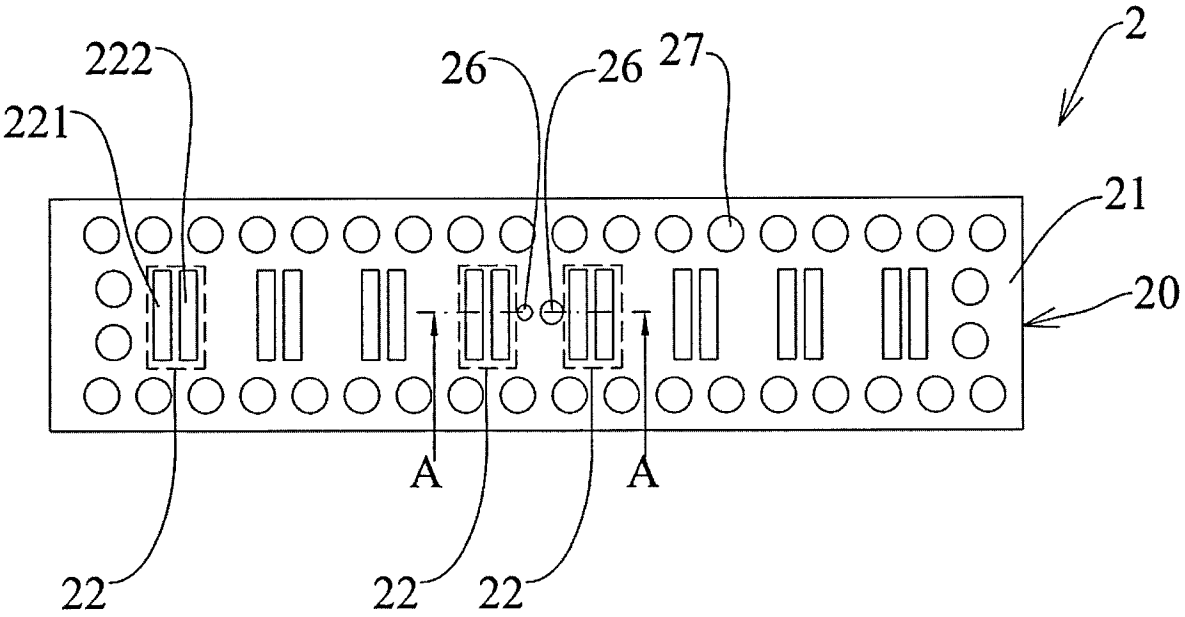
FIG. 2 is a top view of a dual slot SIW antenna unit in accordance with an embodiment of the present invention.
Figure 3:
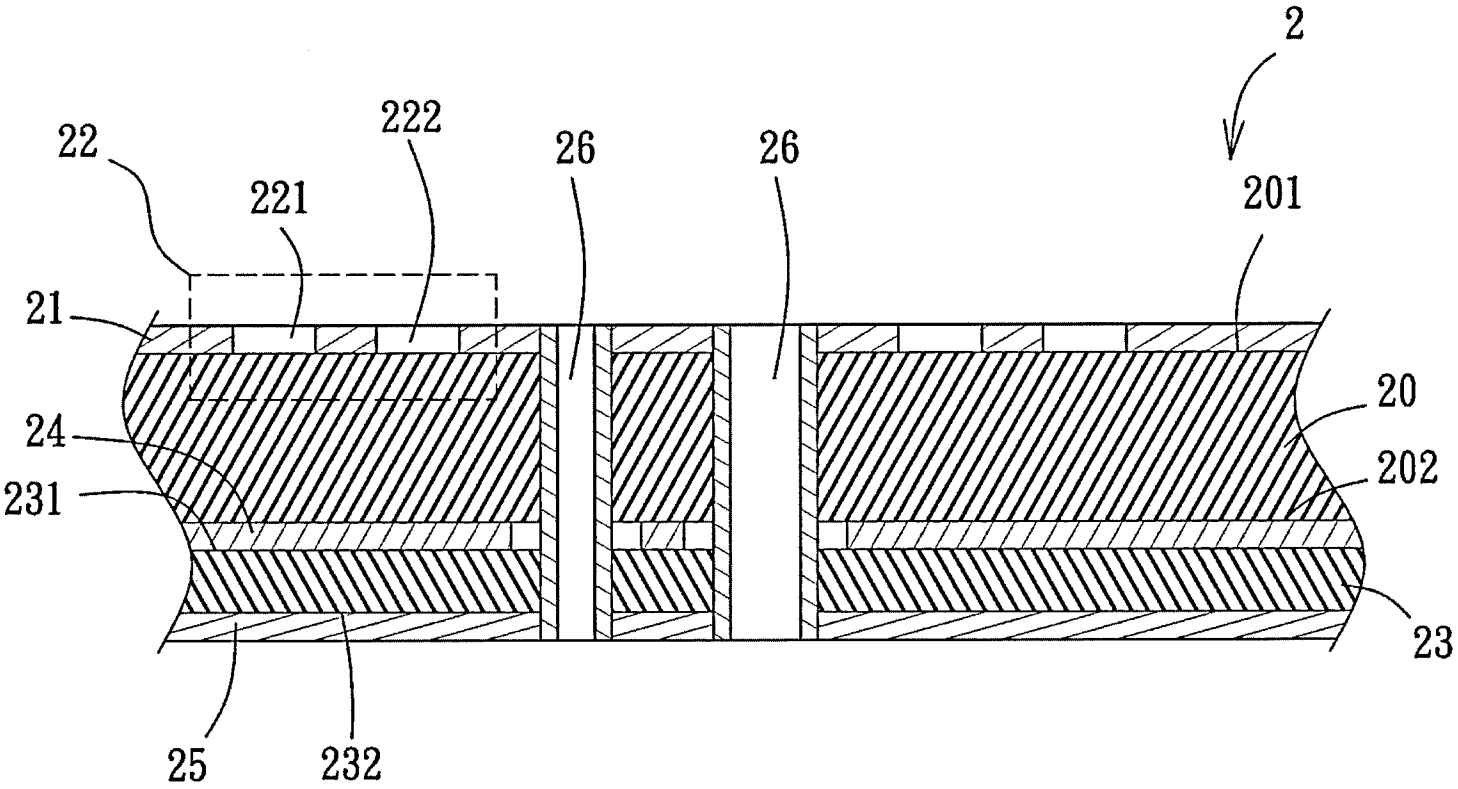
FIG. 3 is a cross-sectional view taken along line A-A in FIG. 2.

Referring to FIG. 2 and FIG. 3 representing a top view and a partially cross-sectional view of a dual slot SIW antenna unit, respectively. As shown by FIG. 2 and FIG. 3, an embodiment of the dual slot SIW antenna unit 2 comprises a first substrate 20, a conductive layer 21, plural unit radiation members 22, a second substrate 23, a ground conductive layer 24, a feed routing layer 25, and two first conductive pillars 26. The conductive layer 21 is disposed on an upper surface 201 of the first substrate 20. Plural radiation members 22 are substantially disposed in parallel relative to each other on the conductive layer 21, wherein each unit radiation member 22 includes at least a pair of slots 221, 222 that are disposed in parallel relative to each other. In an embodiment of the present invention, the slots 221, 222 are formed in a, including but not limited to, rectangular shape. The second substrate 23 is disposed on a lower surface 202 of the first substrate 20. The ground conductive layer 24 is disposed on an upper surface 231 of the second substrate 23 and between the first substrate 20 and the second substrate 23. As shown by the drawings, the feed routing layer 25 is disposed on a lower surface 232 of the second substrate 23, so as to feed a wireless signal to the antenna unit. The two first conductive pillars 26 are disposed between two neighboring unit radiation members 22 and pass through the first substrate 20 and the second substrate 23, so as to electrically connect the feed routing layer 25 and the conductive layer 21. Furthermore, the ground conductive layer 24 is provided with a bore having a diameter larger than the outer diameter of the first conductive pillars 26, or provided with an insulation structure, so as to prevent the first conductive pillars 26 from being electrically connected with the ground conductive layer 24. In a preferred embodiment, the two first conductive pillars 26 are disposed between the two unit radiation members 22 that are most adjacent to the center of the first substrate 20. By feed the antenna through the center of the substrate, the situation of the antenna beam swaying with frequency is reduced, and the bandwidth of the antenna beam is increased. Furthermore, in an embodiment, plural second conductive pillars 27 are disposed around the unit radiation members 22.

In another embodiment, the two first conductive pillars 26 are a reverse-phase feeding structure, the feed routing layer 25 feeds in a y-z direction, which is an asymmetric feeding for the antenna, causing the energy of the arrays on two sides to be unequal. By use of two metal conductive pillars for feeding in a reverse phase, the size of the two metal conductive pillars are adjustable, so that the energy and phase of the antenna arrays on two sides of the upper layer are under controlled. The slots of each unit radiation member emits same phase radiation, such that the energy counteraction is avoided, and the gain of the antenna is efficiently increased.

Figures 4A, 4B:
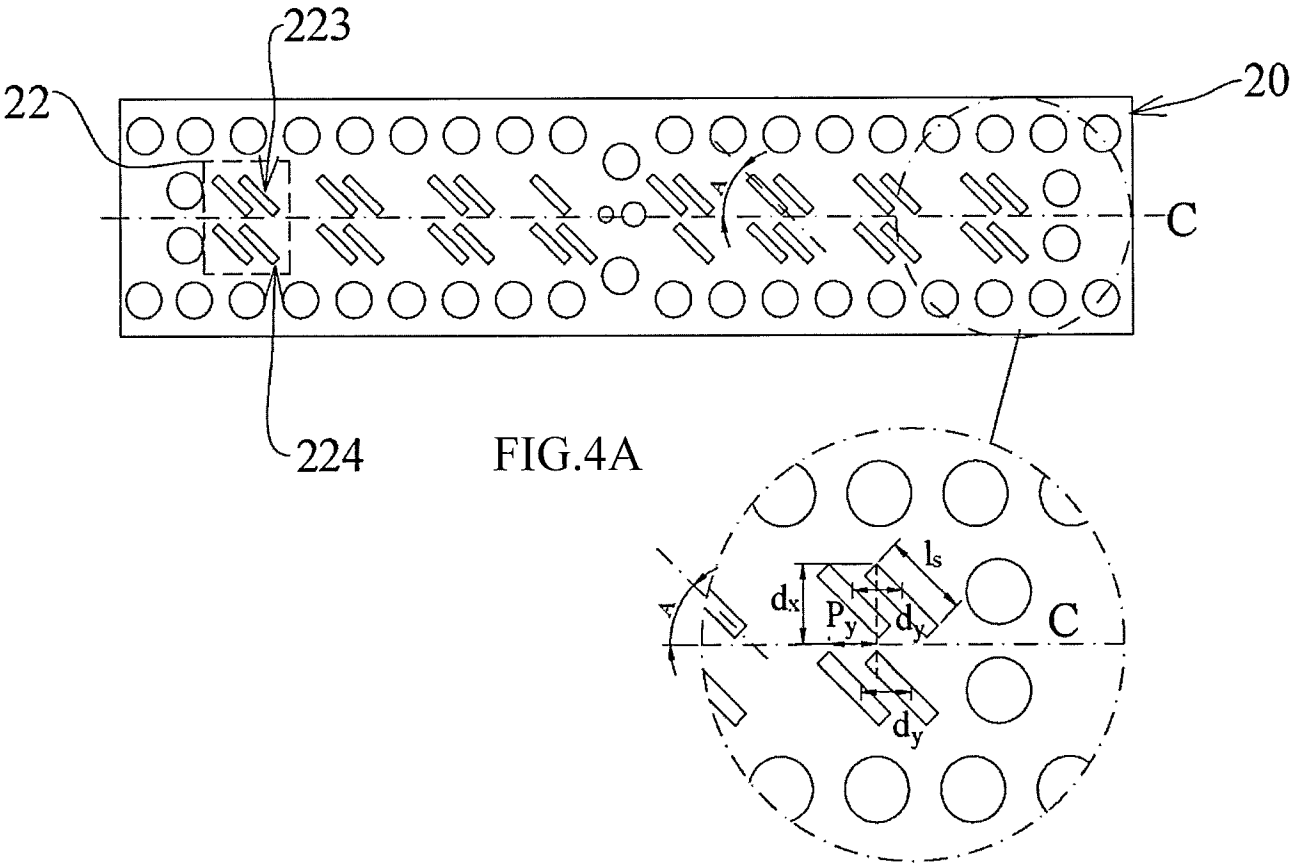
FIG. 4A is a top view of the dual slot SIW antenna unit in accordance with another embodiment of the present invention.
FIG. 4B is a partially enlarged schematic view of FIG. 4A

In still another embodiment, as shown by FIG. 4A and FIG. 4B, the unit radiation member 22 is inclined against the horizontal line C of the first substrate 20 at an angle A. In a preferred embodiment, the angle A is 45 degrees. Also, the unit radiation member 22 is provided with two pairs of slots 223, 224, as shown by FIG. 4A and FIG. 4B. The 45-degree-inclined slots are used to cut off the surface current distribution of the basic waveguide mode, so as to excite the slot radiation and achieve the requirement of a 45-degree polarization direction. The design of plural slots increases the radiation aperture. By controlling the positional parameters of the slots, such as the relative distance dx between the slots and the central line of waveguide, the relative horizontal distance dy between the slots, the relative distance $P_y$ between the two vertically paired slots, and the length of the slot $I_s$, the radiation energy and operation frequency are controlled. In an antenna design for the most optimized gain value, each slot must be equivalent to a unit antenna, so that the array factors shall be taken into consideration. By a slot design provided with multiple variations, the adjustability of variations of the antenna is able to be optimized in the limitation of a common manufacturing procedure. Also, the multiple slots design also applies a principle of increasing the surface current routes to shorten the distance between the radiation units, so that the distance is not necessary to be equal to the length of a waveguide. The amount of the radiation units in a fixed square measure is allowed to be increased for optimizing the radiation gain of the antenna.

Figure 5:
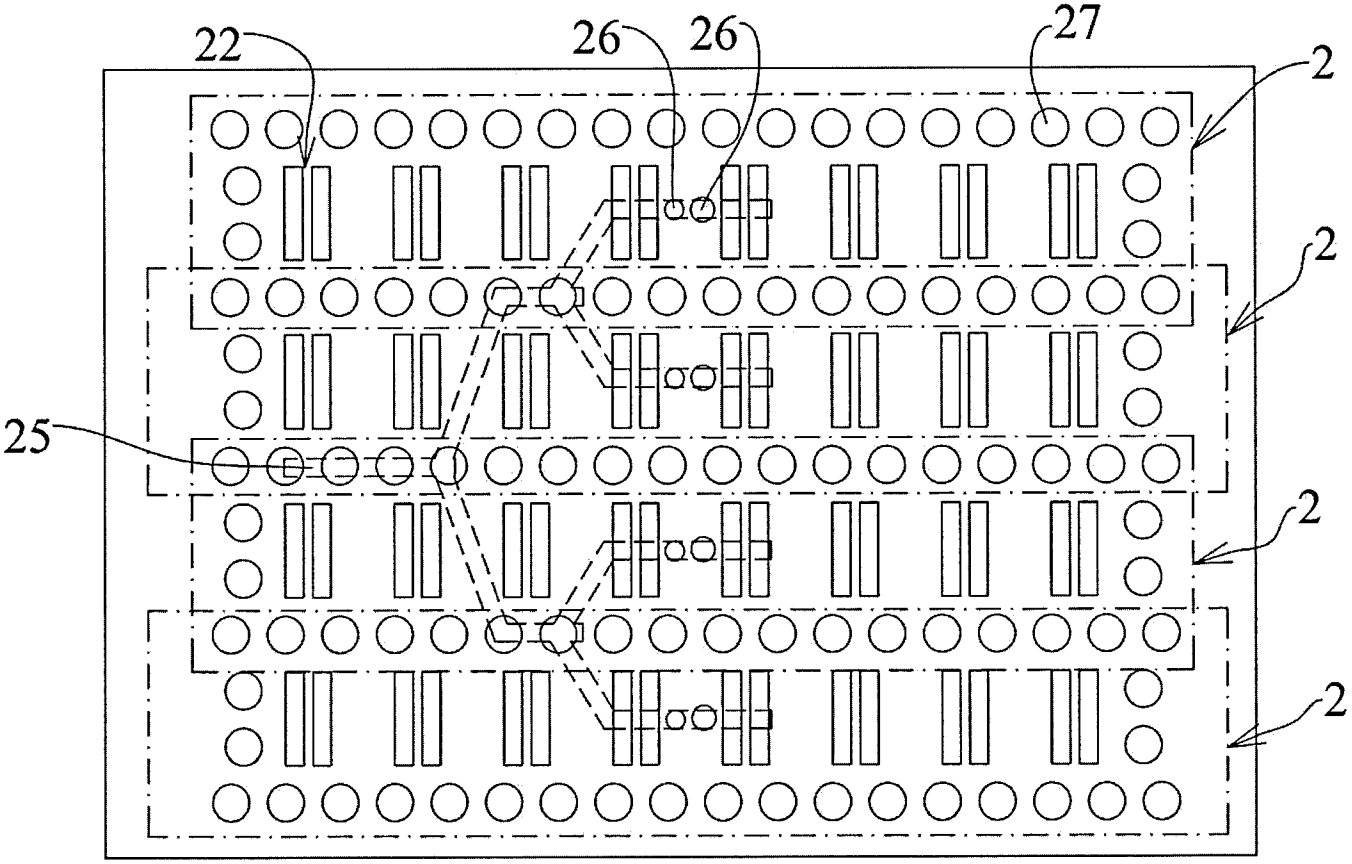
FIG. 5 is a schematic view illustrating a dual slot SIW antenna unit array module in accordance with an embodiment of the present invention.
Figure 6:
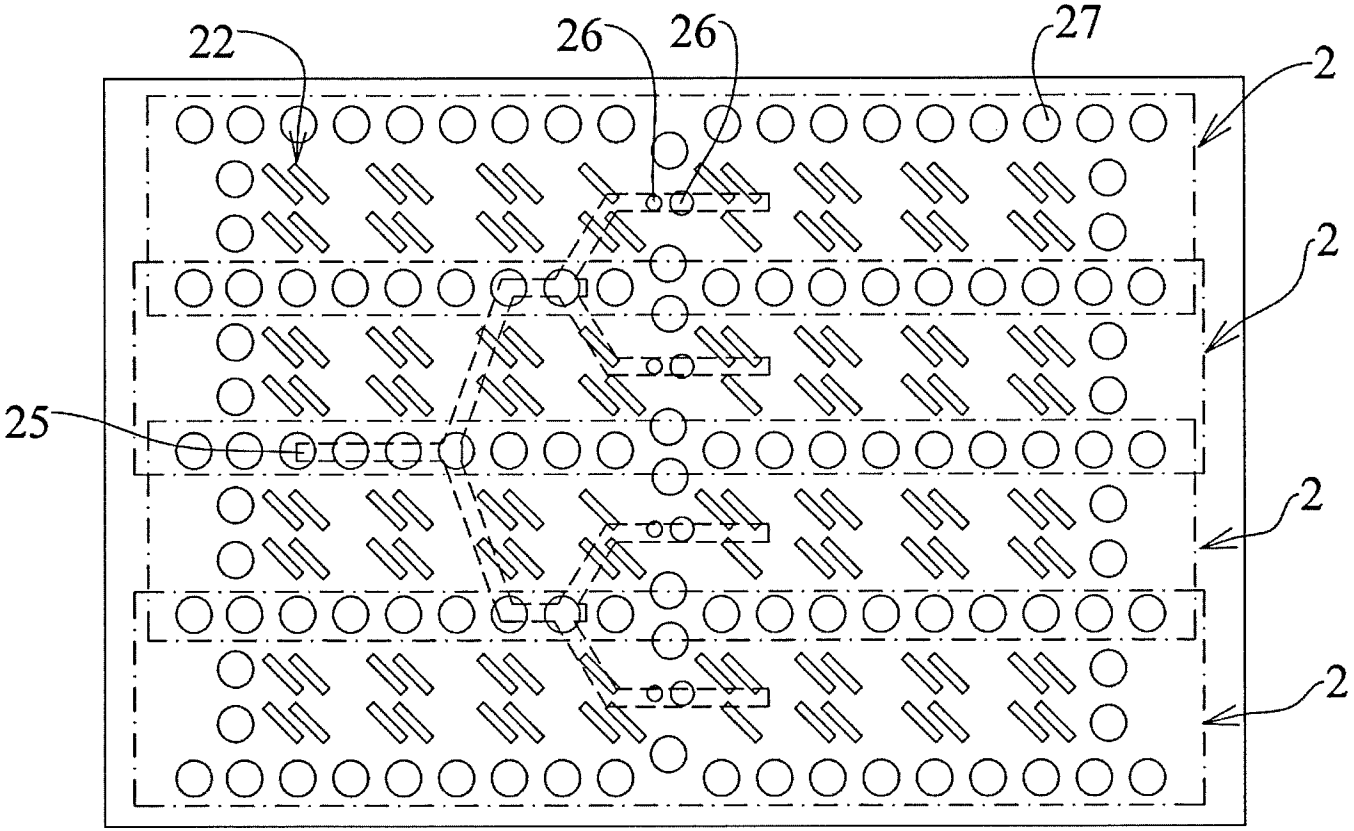
FIG. 6 is a schematic view illustrating a dual slot SIW antenna unit array module in accordance with another embodiment of the present invention.

Furthermore, the FIG. 5 and FIG. 6 schematically illustrate different embodiments of the dual slot SIW antenna array modules in accordance with the present invention. The difference between the current embodiments and aforementioned embodiments lies in that the dual slot SIW antenna array module includes multiple dual slot SIW antenna units 2 that are disposed in an array arrangement. Also, plural second conductive pillars 27 are disposed around the plural unit radiation members 22. Regarding each two neighboring dual slot SIW antenna units 2, the plural conductive pillars 27 sandwiched by the two neighboring dual slot SIW antenna units 2 are shared by the two dual slot SIW antenna units 2, and feed routing layer 25 electrically connects the plural first conductive pillars 26. The structures of other components and configuration of the current embodiments are omitted due to the similarity of them against the structure of the previously mentioned embodiments. Besides, as shown by FIG. 5 and FIG. 6, the feed routing layer 25 of the lower layer feeds the antenna through the two first conductive pillars disposed at the center. Such reverse-phase feeding structure reduces the issue of a biased main beam of the antenna caused by the phase accumulation of the radiation members of the antenna array. For achieving a high gain value requirement, bias of the beam results in a great decrease of the gain value. Moreover, the antenna structure disclosed by the embodiments of the present invention greatly increases the bandwidth of the main beam of the antenna array through a central feeding method. Therefore, the main beam within the targeted applying frequency band (76-77 GHz) is prevented from being biased. By feeding through the routing under the multilayer substrate, the square measure of the antenna array is greatly reduced, optimizing the circuit integration and space exploitation in the radar application.

To sum up, the dual slot SIW antenna unit and array module thereof disclosed by the present invention, based on a SIW structure, applies the dual slot antenna as a radiation member, so as to meet a higher antenna gaining requirement during a remote detection of a vehicle radar. However, square measure of the antenna must be limited to decrease the overall volume. The dual slot design allows more radiation members to be included in a limited square measure. Also, the two slots emit radiation in a same phase, so as to avoid the counteraction of the radiation energy and efficiently improve the antenna gain. Furthermore, with the central portion of the waveguide formed by two reverse-phase metal conductive pillars feeding the upper layer substrate from the microstrip feed line, the size of the two metal conductive pillars are adjustable, such that the energy and phase of the antenna arrays on two sides of the upper layer are under controlled to be identical. Also, the beam is less biased with the frequency, and the bandwidth of the beam is increased. In addition, by positioning the radiation with inclined slot pairs that are disposed vertically, the gain of the basic radiation unit is increased, the distance between the substrate components is decreased by increasing the current routes, and the radiation amount of the overall array in a fixed square measure is improved. By controlling the radiation energy and operation frequency through plural parameters, the adjustability of the antenna is able to be optimized in the limitation of a manufacturing procedure. Through the radiation unit being inclined at 45 degrees, a 45-degree linear polarization is achieved. The energy fed by the feed lines is fed to the SIW through the reverse-phase feeding structure of the two medal pillars at the central portion, such that the beam biasing issue caused by phase accumulation of the array. Therefore, the bandwidth of the beam is greatly increased, meeting the high gain requirement within the targeted 76-77 GHz frequency band.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A dual slot SIW antenna unit, comprising:

a first substrate;

a conductive layer disposed on an upper surface of the first substrate;

plural unit radiation members substantially disposed in parallel relative to each other on the conductive layer, each unit radiation member including at least a pair of slots that are disposed in parallel relative to each other;

a second substrate disposed on a lower surface of the first substrate;

a ground conductive layer disposed on an upper surface of the second substrate and between the first and second substrates;

a feed routing layer disposed on a lower surface of the second substrate; and two first conductive pillars disposed between two neighboring unit radiation members, passing through the first substrate and the second substrate, and electrically connecting the feed routing layer and the conductive layer.

2. The antenna unit of claim 1, further comprising plural second conductive pillars are disposed around the unit radiation members.

3. The antenna unit of claim 1, wherein the slots of each of the unit radiation members emit same-phase radiation.

4. The antenna unit of claim 1, wherein the slots are formed in a rectangular shape.

5. The antenna unit of claim 1, wherein the two first conductive pillars are disposed between the two unit radiation members that are disposed most adjacent to a central portion of the first substrate.

6. The antenna unit of claim 1, wherein the two first conductive pillars are a reverse-phase feeding structure.

7. The antenna unit of claim 1, wherein the unit radiation members are inclined at an angle against a horizontal line of the first substrate.

8. The antenna unit of claim 7, wherein the angle is 45 degrees.

9. The antenna unit of claim 7, wherein the unit radiation members refer to two pairs of slots.

10. A dual slot SIW antenna array module, comprising:

a first substrate;

a conductive layer disposed on an upper surface of the first substrate;

a second substrate disposed on a lower surface of the first substrate;

a ground conductive layer disposed on an upper surface of the second substrate and between the first and second substrates;

a feed routing layer disposed on a lower surface of the second substrate; and plural dual slot SIW antenna units disposed in an array arrangement, wherein each dual slot SIW antenna unit comprises:

plural unit radiation members substantially disposed in parallel relative to each other on the conductive layer, each unit radiation member including at least a pair of slots that are disposed in parallel relative to each other;

two first conductive pillars disposed between two neighboring unit radiation members, passing through the first substrate and the second substrate, and electrically connecting the feed routing layer and the conductive layer; and plural second conductive pillars disposed around the plural unit radiation members, wherein regarding each two neighboring dual slot SIW antenna units, the plural second conductive pillars sandwiched by the two neighboring dual slot SIW antenna units are shared by the two dual slot SIW antenna units, and the feed routing layer electrically connects the plural first conductive pillars.

11. The antenna unit of claim 10, wherein the slots of each of the unit radiation members emit a same phase radiation.

12. The antenna unit of claim 10, wherein the slots are formed in a rectangular shape.

13. The antenna unit of claim 10, wherein the two first conductive pillars are disposed between the two unit radiation members that are disposed most adjacent to a central portion of the first substrate.

14. The antenna unit of claim 10, wherein the two first conductive pillars are a reverse-phase feeding structure.

15. The antenna unit of claim 10, wherein the unit radiation members are inclined at an angle against a horizontal line of the first substrate.

16. The antenna unit of claim 15, wherein the angle is 45 degrees.

17. The antenna unit of claim 15, wherein the unit radiation members refers to two pairs of slots.

* * * * *